US007201278B2

(12) United States Patent
Werner

(10) Patent No.: US 7,201,278 B2
(45) Date of Patent: Apr. 10, 2007

(54) METHOD AND APPARATUS FOR PROCESSING SHEET MATERIAL

(75) Inventor: Frank Werner, München (DE)

(73) Assignee: Giesecke & Devrient GmbH, Munich (DE)

( * ) Notice: Subject to any disclaimer, the term of this patent is extended or adjusted under 35 U.S.C. 154(b) by 353 days.

(21) Appl. No.: 10/124,274

(22) Filed: Apr. 18, 2002

(65) Prior Publication Data

US 2002/0167123 A1 Nov. 14, 2002

(30) Foreign Application Priority Data

Apr. 18, 2001 (DE) ..... 101 18 981

(51) Int. Cl.
*B07C 5/00* (2006.01)

(52) U.S. Cl. ..... 209/534; 271/9.13

(58) Field of Classification Search ..... 271/9.13; 209/534, 552, 553, 554; 902/12, 13; 194/206, 194/207

See application file for complete search history.

(56) References Cited

U.S. PATENT DOCUMENTS 4,577,763 A * 3/1986 Placke et al. ..... 209/534
4,736,852 A * 4/1988 Edin et al. ..... 209/534
5,021,639 A * 6/1991 Hara et al. ..... 235/379
5,853,089 A * 12/1998 Milne ..... 209/534
5,894,937 A 4/1999 Schmidt
6,454,163 B2 * 9/2002 Peebles et al. ..... 235/379
6,560,355 B2 * 5/2003 Graves et al. ..... 382/135

FOREIGN PATENT DOCUMENTS

GB 2 128 594 A 5/1984
JP 07325954 12/1995

* cited by examiner

*Primary Examiner*—Joseph Rodriguez
(74) *Attorney, Agent, or Firm*—Bacon & Thomas, PLLC

(57) ABSTRACT

The invention relates to a method and apparatus for processing sheet material, in particular bank notes, having a singling device for singling bank notes, a sensor path for testing at least one property of the singled bank notes and a deposit device having at least one output pocket for bank notes which have traversed the sensor path.

Since the singling of bank notes is effected from a plurality of singlers in controlled order, efficient bank note processing can be performed.

29 Claims, 1 Drawing Sheet

METHOD AND APPARATUS FOR PROCESSING SHEET MATERIAL

BACKGROUND OF THE INVENTION

This invention relates to a method and apparatus for processing sheet material, in particular bank notes, having a singling device for singling sheet material, a sensor path for testing at least one property of the singled sheet material and a deposit device having at least one output pocket for sheets of sheet material which have traversed the sensor path.

A method and apparatus of the abovementioned type is known for example from DE 198 10 928 A1. Bank notes are usually inputted into an input pocket by hand, singled, tested and deposited in an associated output pocket of the deposit device in accordance with the test result. However, it is frequently necessary to readjust the singler in accordance with the type of bank note to be subsequently singled since the optimal singler adjustments are different for bank notes e.g. of different quality. This necessity of readjustment involves an expenditure of time which is undesirable in terms of an optimized throughput in bank note processing.

SUMMARY OF THE INVENTION

The invention is therefore based on the problem of proposing a method and apparatus for processing sheet material, in particular bank notes, that ensures a high throughput in particular when bank notes of different quality, different formats or different currencies are to be singled or processed.

The invention is thus based on the finding that more efficient bank note processing with a higher throughput can be performed by singling sheet material, such as bank notes, from a plurality of singlers in controlled order.

For example, if the singlers are constructed differently, one singler module can be equipped and preadjusted for bank notes of good quality and one for bank notes of poor quality. An inexpensive friction wheel singler for singling good-quality bank notes and a suction singler for poor-quality bank notes can e.g. be coupled. Alternatively, some of the singler modules can e.g. be designed for automatic singling from boxes and others for inputting bundles of bank notes by hand.

In all these cases, no readjustment of the singler is thus necessary for different types of bank notes to be singled, or conversion upon a change from manual input to box singling or to singling of strapped bank notes. Moreover, bank notes can already be inputted into one singler during singling from another of the singlers.

In a preferred embodiment, the bank notes from a plurality of, particularly preferably from all, singler modules will traverse a common sensor path. This case has the further advantage that the in itself very expensive sensor path can be used to capacity virtually without a gap, for example by supplying the bank notes to the sensor path in a continuous stream from the singler modules in controlled fashion one after the other or else interlaced. Interlaced supply is understood to mean e.g. that a second singler selectively inserts bank notes into the singling gaps of the first singler. This can compensate for disturbances in one singler.

For example in case substantially no singler gaps occur, however, a plurality of singlers can also be connected in parallel so that when the first singler has run empty the second singler is switched to.

In addition, all or at least some of the singlers can also traverse their own, separate sensor paths. This has the advantage that the sensors of the sensor path can also be adjusted optimally to the type of bank note to be singled in the associated singler.

Moreover, a singler can further be connected with the output of the sensor path by means of a recirculating transport system, so that bank notes which have for some reason been identified by the sensor path, e.g. qualified as unfit for circulation, traverse said path again.

The singlers can optionally be connected with output pockets common to all singlers, but it is of course also possible to associate certain singlers with certain output pockets. This association can be effected either by the mechanical construction of the transport apparatus from the singler to the output pockets or alternatively by selective control of the sheet supply to the different output pockets.

The former case with common output pockets is advantageous e.g. when bank notes of a deposit, i.e. from a money deposit operation with a plurality of bank notes, are inputted distributed over the different singlers for further processing in order to be subsequently singled without a gap. The latter case with separate output pockets is ex-expedient when different deposits are processed simultaneously and there is no desire to bring together the processed bank notes outputted according to certain criteria.

For connecting the singlers with the apparatus one can fundamentally use any known possibility. The bank notes can be placed directly in input pockets of the singlers which are inserted into the machine, but it is also possible to connect the singlers with the apparatus or the sensor path via separate transport paths.

BRIEF DESCRIPTION OF THE DRAWINGS

In the following an example of the invention will be described by way of example with reference to the enclosed drawing, in which.

DETAILED DESCRIPTION OF THE INVENTION

Figure 1:
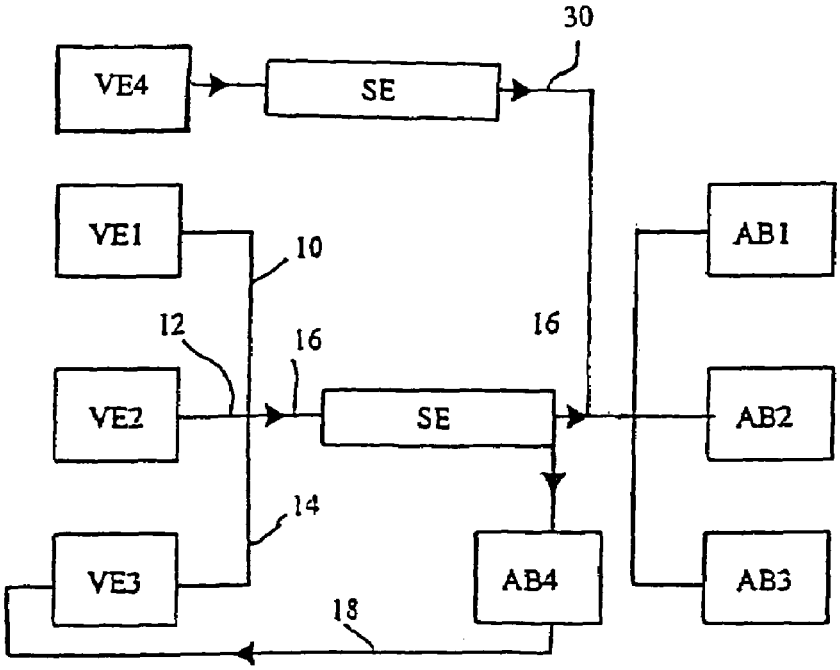
FIG. 1 shows a schematic flowchart of an embodiment of the invention.

The inventive apparatus according to FIG. 1 comprises three different singlers VE1, VE2 and VE3. Said singlers preferably have different constructions. VE1 is for example a singler for receiving boxes with bank notes to be singled or for receiving strapped bundles of bank notes which are then automatically de-strapped before singling. VE2 is for example a comparatively inexpensive friction wheel singler for singling good-quality bank notes, and VE3 is for example a suction wheel or suction belt singler for poor-quality bank notes. Said three singlers are connected via transport paths 10, 12, 14, each associated with the singlers, with main transport path 16 leading through sensor path SE. In sensor path SE a plurality of, for example ten, different sensors are disposed for measuring the particular required properties of bank notes. After traversing sensor path SE the bank notes are selected to output pockets AB1, AB2 or AB3 depending on their state. The output pockets can be charged simultaneously from all singlers, but the control can of course also be effected such that individual singlers, for example singler VE1, always deposits only in output pocket AB1. When bank notes are classified as unfit for circulation or unsuitable for some other reason, they are ejected and deposited in output pocket AB4 after traversing the sensor path. It is possible to return said bank notes to singler VE3 via recirculating transport system 18 so that said bank notes traverse the sensor path again. Only if they are ejected again the bank notes are then reworked by hand.

It is obvious that the shown apparatus permits troublefree singling of very different bank notes. The bank notes from singlers VE1, VE2 and VE3 connected in parallel can be supplied to the sensor path interlaced with each other. It is of course also possi-also possible to first work off singler VE1 and only then connect singler VE2. The corresponding control is not shown in the flowchart. Singlers VE1, VE2, VE3 preferably have different constructions and are each optimized for a certain bank note quality.

It is also possible, however, to use singlers of the same kind in order to obtain optimal utilization of the apparatus. In this case, bank notes can e.g. be added to one singler while another singler is active and singles bank notes.

According to the embodiment shown in FIG. 1, the plurality of singlers VE1, VE2, VE3, VE4 are connected to one another with separate sensor paths SE, 30. For example, singler VE4 is connected to singlers VE1, VE2, VE3 by a separate sensor path 30 which connects to main transport path 16, which in turn connects to output pockets AB1, AB2, AB3.

Figure 2:
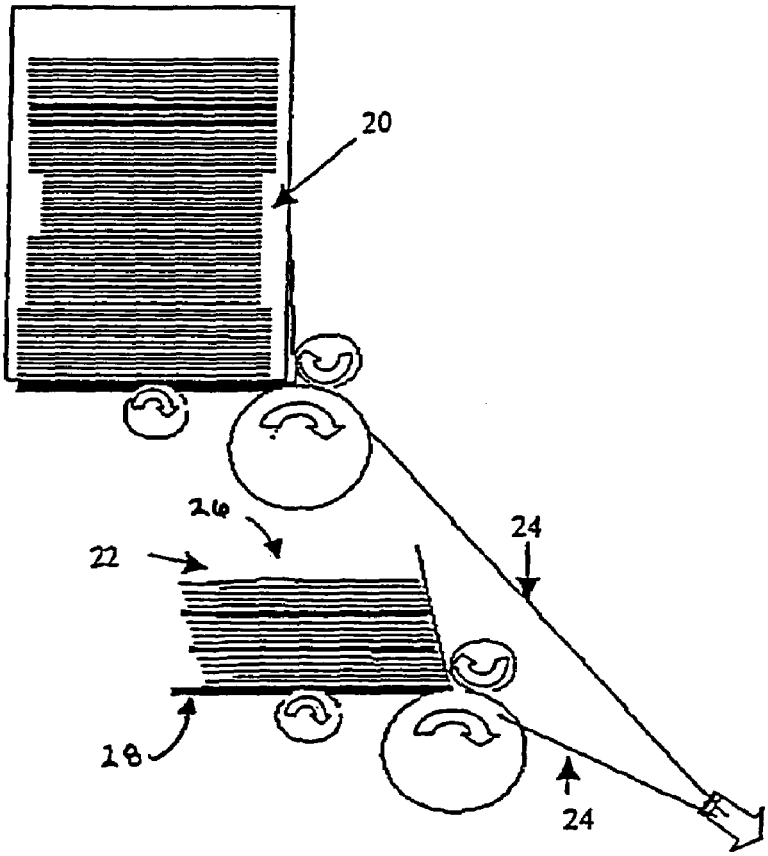
FIG. 2 shows the coupling of two different singlers.

FIG. 2 shows schematically the coupling of two such different singlers. Singler 20 works for example with boxes which are previously filled and inserted into singler 20. Singler 22 works with loose bank note stacks which are placed in the input pocket of singler 22 by hand. Via transport paths 24 the bank notes of both singlers 20, 22 reach sensor path SE of the bank note processing machine via an associated switch and are diverted into the output pockets after testing in accordance with the test result and predetermined sorting criteria.

All in all, by making a plurality of singlers available in parallel one obtains higher flexibility, avoids singling gaps that lead to losses of time, and eliminates time-consuming change-over measures.

According to one embodiment shown in FIG. 2, the singler 22 arranged for manual placement of bank notes defines an opening 26 and a receiving tray 28.

The invention claimed is:

1. A bank note processing apparatus for depositing and measuring properties of bank notes, comprising:

a singling device arranged to single bank notes and including a plurality of singling modules, at least one of the singling modules having a manual input pocket having an opening and a receiving tray for placement of loose bank note stacks;

a common sensor path comprising a plurality of different sensors arranged to measure particular required properties of singled bank notes, the plurality of singling modules connected to the common sensor path;

a plurality of output pockets for receiving bank notes having traversed the common sensor path, the apparatus arranged to divert singled bank notes into the output pockets in accordance with at least one test result obtained from measuring the properties of the bank notes; and a common transport path extending through the common sensor path and positioned between the singling device and the plurality of output pockets such that all singled bank notes are transported to the plurality of output pockets via the common sensor path.

2. The apparatus according to claim 1, further comprising a control device arranged to regulate the singling of bank notes from the plurality singling modules in a controlled order according to the at least one test result.

3. The apparatus according to claim 1, further comprising a control device arranged to direct the bank notes received by the plurality of singling modules to traverse the common sensor path in interlaced order.

4. The apparatus according to claim 1, wherein said plurality of singling modules are each connected with at least one common output pocket or with separate output pockets.

5. The apparatus according to claim 1, wherein a plurality of the singling modules are constructed differently from each other for processing different bank notes and/ior bank notes supplied in different ways.

6. The apparatus according to claim 5, wherein the singling modules are singlers for receiving boxes, and/or for receiving loose or bundles of bank notes, and/or friction singlers, and/or suction singlers.

7. The apparatus according to claim 1, wherein at least one of said singling modules is connected to an output side of the sensor path via a recirculating transport system.

8. The apparatus according to claim 1, wherein an individual transport path is associated with each of the singling modules and connects to the common transport path.

9. A method for depositing and measuring properties of bank notes in a bank note processing apparatus having a plurality of singling modules, the method comprising the steps of:

providing a plurality of bank notes;

manually placing a stack of loose bank notes into an input pocket of one of the singling modules;

singling the bank notes with the singling module;

transporting the singled bank notes along a common sensor path, the plurality of singling modules being connected to the common sensor path;

measuring particular required properties of the singled bank notes with a plurality of different sensors positioned along the common sensor path; and diverting the tested bank notes into a plurality of output pockets in accordance with a test result obtained from measuring properties of the bank notes;

wherein all singled bank notes are transported to the plurality of output pockets via the common sensor path.

10. The method according to claim 9, wherein the singling of bank notes from different singling modules is effected in a controlled order according to measured properties of the bank notes.

11. The method according to claim 9, wherein the bank notes from a plurality of singling modules traverse the common sensor path in interlaced order.

12. The method according to claim 9, wherein tested bank notes from a plurality of singling modules are deposited in at least one common output pocket.

13. The method according to claim 9, wherein tested bank notes from a plurality of singling modules are deposited in at least one separate output pocket.

14. The method according to claim 9, wherein an individual transport path is associated with each of the singling modules and connects to the common transport path.

15. A bank note processing apparatus for depositing and measuring properties bank notes, comprising:

a singling device arranged to single bank notes and including a plurality of singling modules, at least one of the singling modules having an input pocket configured for manual placement of loose bank note stacks;

a sensor path comprising a plurality of different sensors arranged to measure particular required properties of singled bank notes;

a plurality of output pockets for receiving bank notes having traversed the sensor path, the apparatus arranged to divert singled bank notes into the output pockets in accordance with at least one test result obtained from measuring the properties of the bank notes;

wherein a plurality of the singling modules are constructed differently from each other for processing different bank notes and/or bank notes supplied in different ways.

16. The apparatus according to claim 15, wherein an individual transport path is associated with each of the singling modules and connects to a common transport path.

17. The apparatus according to claim 15, wherein the plurality of singling modules are connected with separate sensor paths.

18. The apparatus according to claim 15, wherein the plurality of singling modules are connected with a common sensor path.

19. A method for depositing and measuring properties of bank notes in a bank note processing apparatus having a plurality of singling modules constructed differently from each other for processing different bank notes and/or bank notes supplied in different ways, the method comprising the steps of:

providing a plurality of bank notes;

manually placing a stack of loose bank notes into an input pocket of one of the singling modules;

singling the bank notes with the singling module;

transporting the entire plurality of singled bank notes along a common sensor path, the plurality of singling modules being connected to the common sensor path;

measuring particular required properties of the singled bank notes with a plurality of different sensors positioned along a sensor path; and diverting the tested bank notes into a plurality of output pockets in accordance with a test result obtained from measuring properties of the bank notes and predetermined sorting criteria.

20. The method according to claim 19, further comprising the step of transporting bank notes along individual transport paths associated with and extending from each of the singling modules to a common transport path.

21. The method according to claim 19, wherein the plurality of singling modules are connected with separate sensor paths.

22. The method according to claim 19, wherein the plurality of singling modules are connected with a common sensor path.

23. A bank note processing apparatus for depositing and measuring properties of bank notes, comprising:

a singling device arranged to single bank notes and including a plurality of singling modules, at least one of the singling modules having a manual input pocket having an opening and a receiving tray for placement of loose bank note stacks;

a common sensor path comprising a plurality of different sensors arranged to measure particular required properties of singled bank notes, the plurality of singling modules connected to the common sensor path;

a plurality of output pockets for receiving bank notes having traversed the common sensor path, the apparatus arranged to divert singled bank notes into the output pockets in accordance with at least one test result obtained from measuring the properties of the bank notes; and a common transport path extending through the common sensor path and positioned between the singling device and the plurality of output pockets such that all singled bank notes are transported to the plurality of output pockets via the common sensor path;

wherein at least one of said singling modules is connected to an output side of the sensor path via a recirculating transport system.

24. A bank note processing apparatus for depositing and measuring properties of bank notes, comprising:

a singling device arranged to single bank notes and including a plurality of singling modules, at least one of the singling modules having a manual input pocket having an opening and a receiving tray for placement of loose bank note stacks;

a common sensor path comprising a plurality of different sensors arranged to measure particular required properties of singled bank notes, the plurality of singling modules connected to the common sensor path;

a plurality of output pockets for receiving bank notes having traversed the common sensor path, the apparatus arranged to divert singled bank notes into the output pockets in accordance with at least one test result obtained from measuring the properties of the bank notes;

a common transport path extending through the common sensor path and positioned between the singling device and the plurality of output pockets such that all singled bank notes are transported to the plurality of output pockets via the common sensor path; and a control device arranged to regulate the singling of bank notes from the plurality singling modules in a controlled order according to the at least one test result.

25. A bank note processing apparatus for depositing and measuring properties of bank notes, comprising:

a singling device arranged to single bank notes and including a plurality of singling modules, at least one of the singling modules having a manual input pocket having an opening and a receiving tray for placement of loose bank note stacks;

a common sensor path comprising a plurality of different sensors arranged to measure particular required properties of singled bank notes, the plurality of singling modules connected to the common sensor path;

a plurality of output pockets for receiving bank notes having traversed the common sensor path, the apparatus arranged to divert singled bank notes into the output pockets in accordance with at least one test result obtained from measuring the properties of the bank notes;

a common transport path extending through the common sensor path and positioned between the singling device and the plurality of output pockets such that all singled bank notes are transported to the plurality of output pockets via the common sensor path; and a control device arranged to direct the bank notes received by the plurality of singling modules to traverse the common sensor path in interlaced order.

26. A method for depositing and measuring properties of bank notes in a bank note processing apparatus having a plurality of singling modules, the method comprising the steps of:

providing a plurality of bank notes;

manually placing a stack of loose bank notes into an input pocket of one of the singling modules;

singling the bank notes with the singling module;

transporting the singled bank notes along a common sensor path, the plurality of singling modules being connected to the common sensor path;

measuring particular required properties of the singled bank notes with a plurality of different sensors positioned along the common sensor path; and diverting the tested bank notes into a plurality of output pockets in accordance with a test result obtained from measuring properties of the bank notes;

wherein all singled bank notes are transported to the plurality of output pockets via the common sensor path;

wherein the singling of bank notes from different singling modules is effected in a controlled order according to measured properties of the bank notes.

27. A method for depositing and measuring properties of bank notes in a bank note processing apparatus having a plurality of singling modules, the method comprising the steps of:

providing a plurality of bank notes;

manually placing a stack of loose bank notes into an input pocket of one of the singling modules;

singling the bank notes with the singling module;

transporting the singled bank notes along a common sensor path, the plurality of singling modules being connected to the common sensor path;

measuring particular required properties of the singled bank notes with a plurality of different sensors positioned along the common sensor path; and diverting the tested bank notes into a plurality of output pockets in accordance with a test result obtained from measuring properties of the bank notes;

wherein all singled bank notes are transported to the plurality of output pockets via the common sensor path; and wherein the singling of bank notes from different singling modules is effected in a controlled order according to measured properties of the bank notes.

28. A bank note processing apparatus for depositing and measuring properties bank notes, comprising:

a singling device arranged to single bank notes and including a plurality of singling modules, at least one of the singling modules having an input pocket configured for manual placement of loose bank note stacks;

a sensor path comprising a plurality of different sensors arranged to measure particular required properties of singled bank notes;

a plurality of output pockets for receiving bank notes having traversed the sensor path, the apparatus arranged to divert singled bank notes into the output pockets in accordance with at least one test result obtained from measuring the properties of the bank notes;

wherein a plurality of the singling modules are constructed differently from each other for processing different bank notes and!or bank notes supplied in different ways; and wherein the plurality of singling modules are connected with separate sensor paths.

29. A method for depositing and measuring properties of bank notes in a bank note processing apparatus having a plurality of singling modules constructed differently from each other for processing different bank notes and/or bank notes supplied in different ways, the method comprising the steps of:

providing a plurality of bank notes;

manually placing a stack of loose bank notes into an input pocket of one of the singling modules;

singling the bank notes with the singling module;

transporting the entire plurality of singled bank notes along a common sensor path, the plurality of singling modules being connected to the common sensor path;

measuring particular required properties of the singled bank notes with a plurality of different sensors positioned along a sensor path;

diverting the tested bank notes into a plurality of output pockets in accordance with a test result obtained from measuring properties of the bank notes and predetermined sorting criteria; and wherein the plurality of singling modules are connected with separate sensor paths.

* * * * *